United States Patent [19]

Nolan

[11] Patent Number: 4,988,272

[45] Date of Patent: Jan. 29, 1991

[54] GROUT COMPRESSING AND FINISHING TOOL

[76] Inventor: Kenneth J. Nolan, P.O. Box 42, Gilbertsville, N.Y. 13776

[21] Appl. No.: 318,829

[22] Filed: Mar. 6, 1989

[51] Int. Cl.[5] ..... B28B 1/29; B05C 17/10/17/12

[52] U.S. Cl. ..... 425/087; 15/235.3; 425/458

[58] Field of Search ..... 425/87, 458; 15/235.3, 15/235.4; D8/45

[56] References Cited

U.S. PATENT DOCUMENTS

| | | | |
|---|---|---|---|
| 1,000,333 | 8/1911 | Hall | 425/458 |
| 1,327,151 | 1/1920 | Frazier | 15/235.3 |
| 1,509,457 | 9/1924 | Wickham | 15/235.3 |
| 2,539,629 | 1/1951 | Knight | 15/235.3 |
| 2,561,336 | 7/1951 | Bucsko et al. | 15/235.3 |
| 2,674,005 | 4/1974 | Simon | 425/458 |
| 3,389,420 | 6/1968 | Pryor | 15/235.3 |
| 4,432,115 | 2/1984 | Fehler | 15/235.3 |

FOREIGN PATENT DOCUMENTS

| | | | |
|---|---|---|---|
| 496236 | 9/1953 | Canada | 15/235.3 |
| 226615 | 8/1985 | Fed. Rep. of Germany | 15/235.6 |
| 2035432 | 6/1980 | United Kingdom | 15/235.3 |

*Primary Examiner*—Jay H. Woo
*Assistant Examiner*—K. P. Nguyen
*Attorney, Agent, or Firm*—Charles S. McGuire

[57] ABSTRACT

A tool for compressing and finishing the grout in joints between ceramic and mosaic tiles and the like. The tool includes a handle portion for gripping the device and a flexible yet resilient elongated shaft portion extending linearly therefrom. The shaft portion is bent about 20 degrees at a point approximately midway the length of the rod thereby forming two straight and distinct portions. The portion furthest from the handle, that is, the distal portion of the rod is placed atop the unhardened, exposed grout in the joints between tegular elements applied to a surface such that the entire distal portion is in contact with the grout material while the proximial portion of the rod assumes an approximately 20 degree angle with the surface. In this manner the user moves the tool along the grout joint while applying a desired amount of pressure such that the grout is compressed within the joints between tegular elements while it is also topically smoothed in an aesthetically appealing manner.

5 Claims, 1 Drawing Sheet

GROUT COMPRESSING AND FINISHING TOOL

BACKGROUND OF THE INVENTION

This invention relates to material working tools and more particularly to a tool for finishing grout material and the like in the joints formed between tegular elements applied to a surface.

The construction of tegular surfaces is typical today in the interior/exterior design field, examples of which may be found in many commercial establishments as well as the home dwelling. In the industry, it is typical for those skilled in the art to apply a semi-solid material such as grout or mortar into the elongated, intersecting spaces, i.e. joints, which are formed as a result of applying tegular elements to a surface. In such application, undesirable air pockets near the underlying surface are inadvertently formed and the grout usually acquires a highly irregular surface. It is therefore highly desirable to level off the grout in a manner such that it is compressed and restricted within the joints between the tiles thereby increasing the strength of the tegular surface and its aesthetic appeal.

Tools which have been employed to accomplish this task vary from using the handle end of a toothbrush to tools specifically designed and manufactured for this purpose, achieving respectively varied results. An example of such a tool is disclosed in U.S. Pat. No. 3,964,854, issued to Groeneveld on June 22, 1976. The '854 patent claims a tool used for scraping and pressing the joint material between tegular elements which comprises a hand gripped handle in connection with a head-tipped portion, the terminal end of which may be moved along the joint between the tiles to press and smooth the jointing material. The single terminal end employed by the '854 patent restricts the amount of pressure which may be applied without dragging the grout material out of the joint and, hence, is not much better at achieved results than the toothbrush handle. A similar device is shown in Design Pat. No. D 249,014, issued Aug. 22, 1978, also to Groeneveld. It is therefore a main object of the present invention to provide an improved grout finishing tool which is simple in both design and use.

A further object is to provide a grout finishing tool which may be moved smoothly across the grout material with one stroke which firmly compresses the grout into the joints.

Still another object is to provide a grout finishing tool which is very smooth and slick in material form and design so as to let the tool slide along the grout surface without marring the tile surface and prohibit dragging of the grout material out of the joint.

A still further object is to provide a grout finishing tool which produces a smooth and concave joint which has increased water resistance and is aesthetically appealing.

Other objects will in part be obvious and in part appear hereinafter.

SUMMARY OF THE INVENTION

The present invention is directed to providing a simple yet surprisingly effective tool for finishing jointing material such as grout and mortar between tegular elements applied to a surface. When such jointing material is applied in the usual manner it is necessary that it then be compressed and formed into the crevice between the tiles to effect a strong and secure placement of the tiles to the surface. It is also desirable to smooth the jointing material into a somewhat concave shape thereby disallowing any significant retention of water when so exposed upon a substantially vertical positioning of the tiles.

It is intended that the present tool be capable of achieving its desired results of a compressed, smooth and concave shape when used on semi-solid jointing material between tegular elements which form straight, elongated and intersecting crevices or joints when applied to a surface. A single stroke or passage of the tool along the joint is sufficient to achieve the desired result. The portion of the tool coming into operational engagement with the jointing material is designed such that it allows for maximum compression of the jointing material into the joint without dragging any of the material out of the joint. The result is a smooth, concave and aesthetically appealing joint.

The tool is a single piece device comprising an elongated, squared handle portion for gripping the device in connection with an elongated shaft portion extending linearly therefrom. The shaft is bent at an angle of preferably about 20 degrees at a point approximately midway the length of the shaft, thereby dividing the shaft into two separate and distinct, straight portions. The distal portion of the shaft is laid atop the jointing material such that the proximal portion assumes a 20 degree angle with the surface of the joint. The tool is then drawn along the jointing material in the direction of the joint while the user applies an appropriate amount of pressure, thereby compressing and smoothing the grouting material into the joint.

The tool is constructed from a material such as nylon, polypropylene, polycarbonate or ABS plastic which allows the shaft portion to be flexible yet resilient, allowing for maximum compression of the jointing material when the straight and elongated distal portion of the shaft comes into operational engagement with the jointing material.

DETAILED DESCRIPTION

Figure 1:
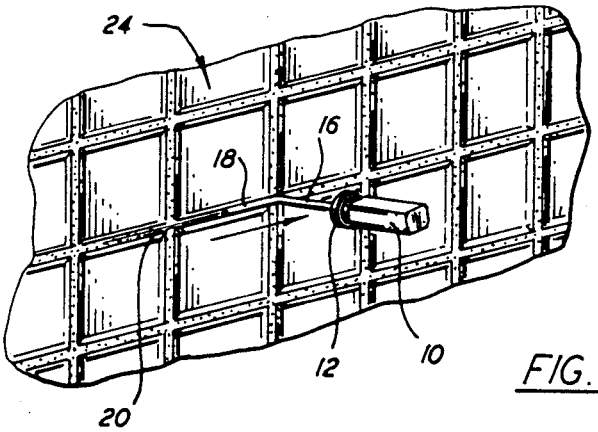
FIG. 1 is a perspective view of the tool of the invention, shown in operational engagement with the jointing material of a tegular surface.
Figure 2:
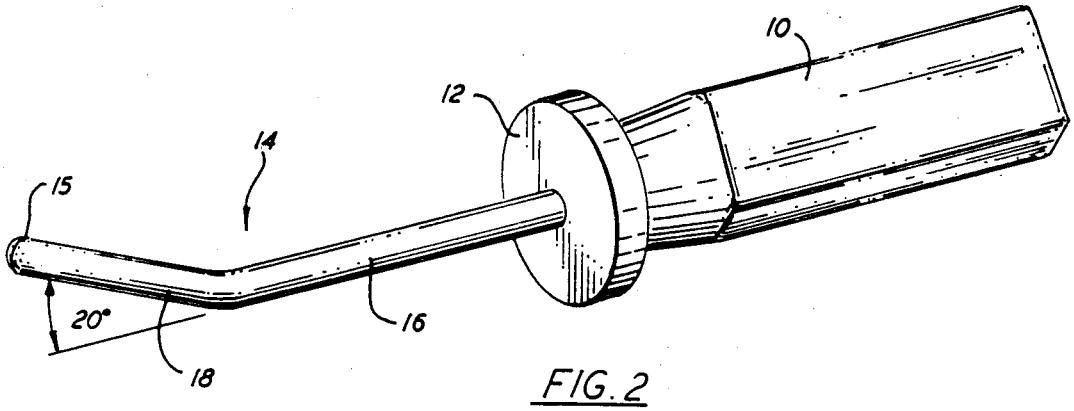
FIG. 2 is a perspective view of the invention, drawn substantially to the preferred size.

Referring now to the drawings, there is shown in FIG. 2 a perspective view of the perferred embodiment of the invention. A somewhat squared handle portion 10 is provided for ease of gripping the device. Circular segment 12 is provided at one end of handle 10 for resting the user's thumb when the tool is held in the intended fashion. In this way, the user may simply apply the desired amount of pressure with his thumb upon circular segment 12, or upon the handle behind the circular segment, when the tool is in contact with the jointing material, as seen in FIGS. 1 and 3, thereby compressing the jointing material into the joint.

Shaft 14, of circular cross section, extends linearly from handle 10 and circular segment 12 and is bent approximately 20 degrees at a point between handle 10 and rounded free end 15, thereby dividing shaft 14 into two seperate and distinct linear portions 16 and 18. In the preferred embodiment, portions 16 and 18 are approximately 2" and 1½" in length, respectively.

Figure 3:
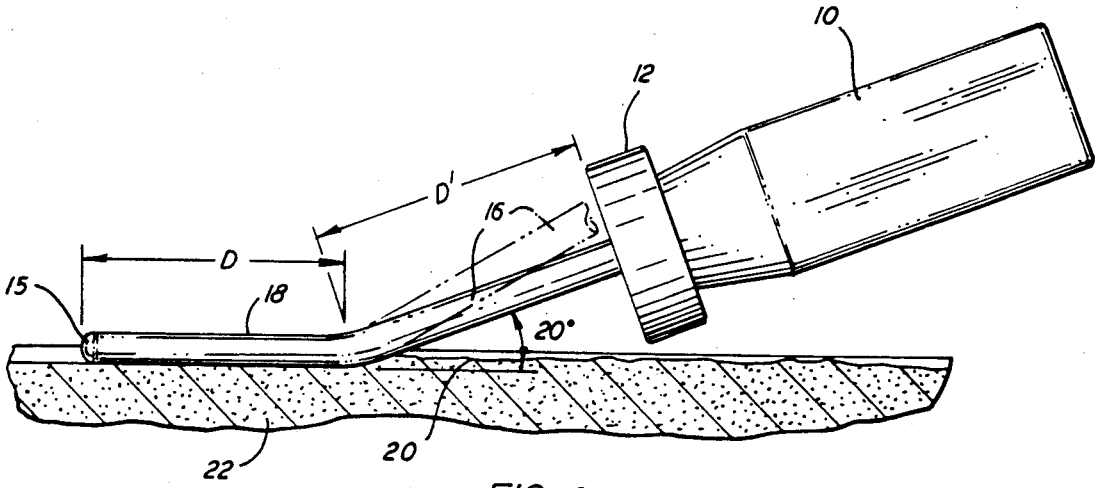
FIG. 3 is an elevational view of the invention showing the distal portion of the shaft in contact with jointing material applied to a surface, the proximal portion of the shaft assuming an approximately 20 degree angle with the surface.

Utilizing the tool simply requires the user to place distal shaft portion 18 atop jointing material 20 applied to a surface 22 such that proximal shaft portion 16 assumes an approximately 20 degree angle with jointing material 20, as shown in FIG. 3. The tool is then drawn along the jointing material 20 in the direction of the joint, as shown in FIG. 1, distal shaft portion 18 maintaining constant contact with jointing material 20, which has been applied in the joints of a typical tegular surface 24. A single stroke of the tool along the jointing material 20 is sufficient to compress and smooth it into a substantially concave shape. Rounded end 15 permits the necessary working of the tool at corners or adjacent the terminal ends of joints.

The tool is preferably constructed as a one-piece molding of a flexible yet resilient material such as nylon, polypropelyne, polycarbonate, or ABS plastic thereby allowing the necessary amount of pressure to be applied upon distal portion 18. The squared surface of handle 10 tends to prevent it from twisting or slipping in the user's hand as pressure is applied. Also, such materials are smooth to the touch and therefore allow such pressure to be applied without dragging any of the jointing material 20 out of the joint or marring the tile surface. Due to the flexibility of the material, and the cross-sectional dimension of shaft 14, portion 16 will flex to a greater angle with respect to distal portion 18 as the pressure is applied, as indicated in dotted lines in FIG. 3. The natural resilience of the material returns the shaft sections to their original angular orientation when the pressure on the handle is removed. The diameter of shaft 14 is preferably approximately equal to the width of the joints, i.e., the spacing between adjacent tiles, typically about 3/16" in many popular ceramic tile installations. The result is a smooth, concave and aesthetically appealing joint.

What is claimed is:

1. A tool for compressing and finishing grout in joints between adjacent tegular elements applied to a surface, said tool comprising:

(a) a handle portion having a longitudinal axis and adapted to be gripped for manual manipulation of said tool; and (b) an elongated shaft portion of constant circular cross-section throughout its length, including:

(i) a proximal section fixedly attached to said handle portion and extending linearly therefrom along said longitudinal axis; and (ii) a distal section of substantially shorter length than the linear combination of said handle portion and said proximal section, extending integrally from said proximal section along a linear axis arranged at a predetermined acute angle with respect to said longitudinal axis, said distal section having a surface positioned and configured for contact with said grout to compress and smooth said grout into said joint in a substantially concave shape as said tool is drawn along said joint, said distal section having a free end of the same diameter as said elongated shaft portion, said free end being smoothly rounded such that said free end is especially useful in compressing and smoothing said grout into an inside corner when two or more tegular surfaces are in a normal and multi-planar relationship to each other.

2. The invention according to claim 1 wherein said shaft portion is of limited flexibility, whereby pressure applied to said handle portion while said distal section is in contact with said grout causes said proximal and distal sections to be arranged at an angle greater than said predetermined acute angle.

3. The invention according to claim 2 wherein said shaft portion is of a flexible yet resilient low-friction material.

4. The invention according to claim 3 wherein said material is a rigid, smooth-surfaced plastic.

5. The invention according to claim 4 wherein said tool is formed as a one-piece molding of said plastic.

* * * * *